United States Patent [19]

Gingras

[11] 4,013,370

[45] Mar. 22, 1977

[54] FOUNTAIN TOOTH-BRUSH

[76] Inventor: Antoine Gingras, 3705 St. Joseph Boulevard, East - Apt., Montreal, Quebec, Canada

[22] Filed: Dec. 1, 1975

[21] Appl. No.: 636,618

[52] U.S. Cl. ..... 401/175; 222/390; 185/37; 401/287

[51] Int. Cl.² ..... A46B 11/02

[58] Field of Search ..... 401/175, 287; 222/390; 185/37; 46/206

[56] References Cited

UNITED STATES PATENTS

| | | | |
|---|---|---|---|
| 1,988,557 | 1/1935 | Jecker | 401/287 X |
| 2,041,605 | 5/1936 | Heilweil | 401/175 |
| 2,420,825 | 5/1947 | Hutton | 185/37 |
| 2,991,915 | 7/1961 | Boehm | 222/390 X |

FOREIGN PATENTS OR APPLICATIONS

| | | | |
|---|---|---|---|
| 613,399 | 5/1935 | Germany | 401/175 |

*Primary Examiner*—Lawrence Charles

[57] ABSTRACT

A tooth-brush carries its own supply of tooth paste in a removable cartridge inserted into the tooth-brush handle. The tooth paste is discharged through a passage from the cartridge to a flexible nipple located between the tooth-brush bristles. A piston is located in the cartridge to push the tooth paste towards the bristles. The piston has a groove engaging a longitudinal rib of the cartridge to prevent rotation of the piston. A screw is threaded through the piston and has a head urged forwardly by a spring abutting against a cap rigid with the tooth-brush handle. Upon screwing of the screw by a knob at the end of the tooth-brush body, the screw is caused to move rearwardly to a limit position to thereby compress the spring. The cocked spring produces slow and uniform discharge of a measured amount of tooth paste over the bristles by moving the screw and, therefore, the piston forwardly. A unidirectional clutch separates the knob and the screw head to prevent unwanted retraction of the piston and to permit replacement of the cartridge.

5 Claims, 7 Drawing Figures

Fig. 1
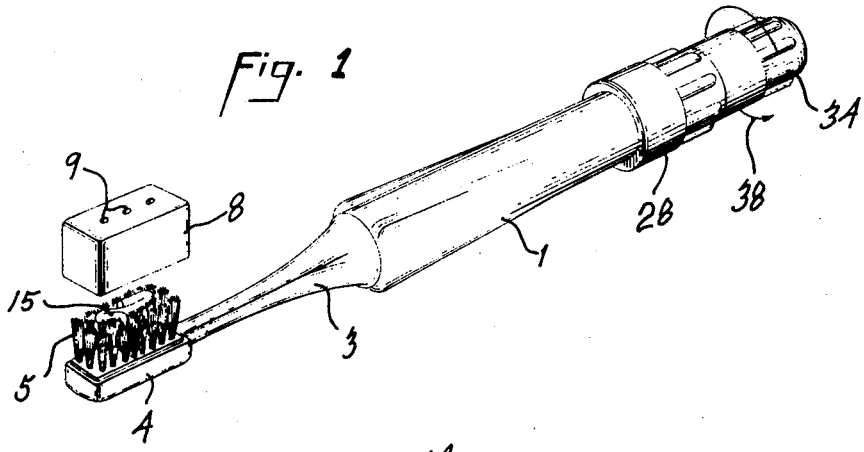
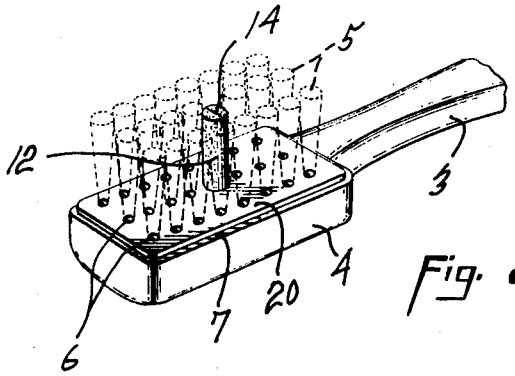
Fig. 2
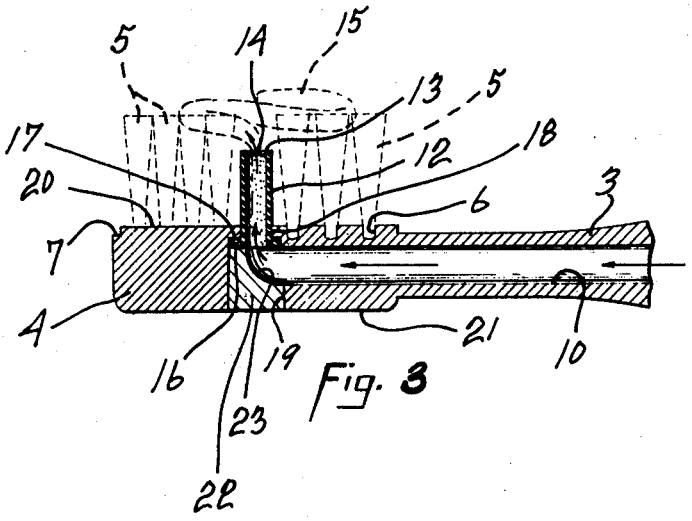
Fig. 3

FOUNTAIN TOOTH-BRUSH

The present invention relates to fountain type tooth-brushes, that is to tooth-brushes carrying their own supply of tooth paste which, by operation of a knob, is discharged onto the tooth-brush bristles ready for use.

Known fountain type tooth-brushes of the character described lack adequate control of the amount of tooth paste discharged at each manipulation resulting in excessive tooth paste discharged, with resultant messy condition. Also, known tooth-brushes of the above-mentioned type have no means of preventing drying of the tooth paste in the discharge passageway and, therefore, often become plugged up, requiring frequent cleaning.

It is the general object of the invention to provide a fountain type tooth-brush which overcomes the above-noted disadvantages and, more particularly, which is provided with means to accurately control the amount of tooth paste discharged on the tooth-brush bristles, which is provided with means to prevent drying of the tooth paste in the passage and which is adapted to receive a separate cartridge of tooth paste readily and easily fitted within the tooth-brush handle or body.

Another object of the invention resides in the provision of a fountain tooth-brush of the character described, which can be made of molded plastic material, resulting in an inexpensive tooth-brush carrying a maximum supply of tooth paste for its total volume.

The foregoing and other objects of the invention will become more apparent during the following disclosure and by referring to the drawings, in which:

FIG. 1 is a perspective view of the fountain type tooth-brush of the invention;

FIG. 2 is a perspective view of the brush head and tooth paste discharge nipple showing the bristle tufts in dotted line;

FIG. 3 is a longitudinal section of the tooth-brush head;

In the drawings, like reference characters indicate like elements throughout.

Figure 4:
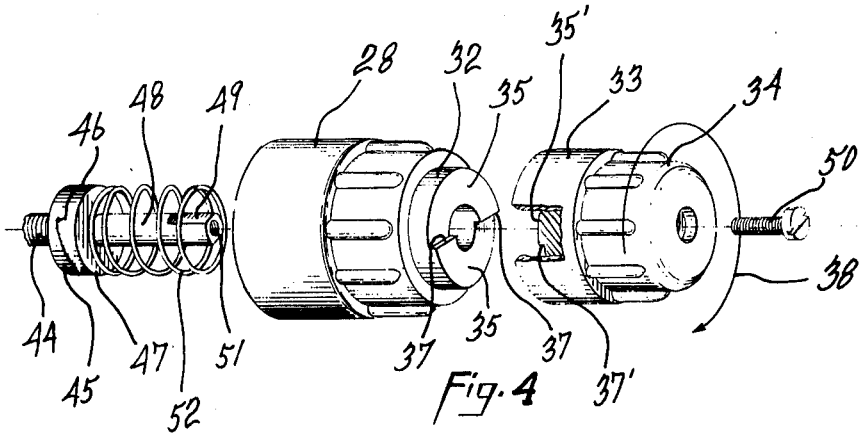
FIG. 4 is an exploded perspective view of the rear operating assembly of the piston.
Figure 5:
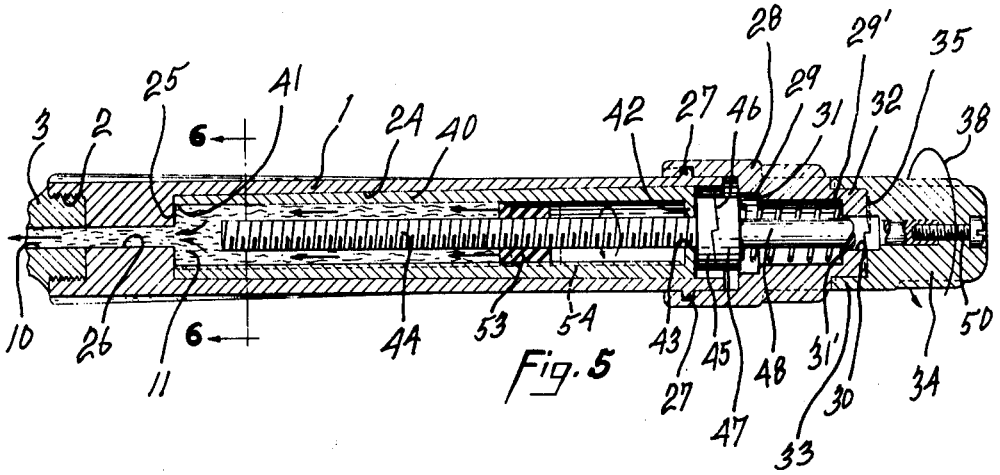
FIG. 5 is a longitudinal section of the tooth-brush and operating assembly.
Figure 6:
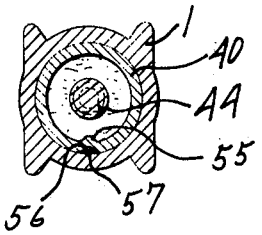
FIG. 6 is a cross-section along line 6—6 of FIG. 5.
Figure 7:
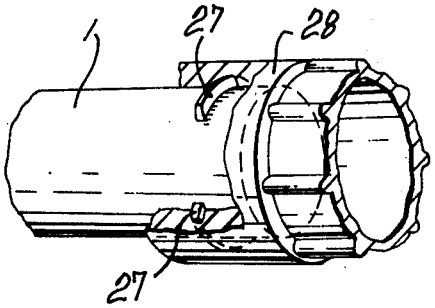
FIG. 7 is a perspective view of the rear end of the tooth-brush handle and cap shown in partial cross-section.

The tooth-brush of the invention includes an elongated handle forming body 1, to the forward end of which is secured, for instance, by screw threads 2, the rear end of a stem 3 integrally forming at its front end a tooth-brush head 4 carrying, in a conventional manner, a plurality of bristle tufts 5 fitted within holes 6 of the head.

The face of the head to which the tufts 5 are fitted forms a perimetral shoulder 7 adapted to removably receive with a snug fit a bristle cover 8 having aerating holes 9 made therethrough.

The stem 3 has a passageway 10 for the supply of tooth paste 11 to the bristles 5.

The passage 10 extends within head 4 and is in communication with a flexible nipple 12, of rubber or the like, which is carried by the head 4 and extends upwardly within the tufts 5 of bristles, preferably centrally of the array of said tufts 5 and terminating short of the outer ends of the bristles.

Nipple 12 is closed at its upper end by a slitted membrane 13 integral with the nipple. The slit 14 opens when the tooth paste is under pressure to permit discharge of a ribbon of tooth paste, as shown at 15, and automatically closes when the inside pressure of the tooth paste is released, thereby preventing air entrance within the nipple and, therefore, eliminating any possible drying of the tooth paste and plugging of the passageway 10 and of the nipple inside conduit.

The nipple 12 is provided with an outwardly protruding flange 16 at its inner end fitted against a shoulder 17 formed at the junction of the smaller diameter hole 18 with the larger diameter hole 19. Hole 18 opens at the front face 20 of the head 4, while hole 19 opens at the back face 21 of the head 4. Hole 19 is closed by a plug 22 permanently cemented therein. Plug 22 has a curved passage section 23 establishing communication between the nipple 12 and the stem passage 10.

Body 1 has a cylindrical cavity 24 extending longitudinally thereof fully opening at the back end of the body 1 and terminated forwardly by a transverse front all 25, through the center of which opens a passage 26 in communication with the cavity 24 and with the stem passage 10.

The rear end of the body 1 has interrupted threads 27 for quick threading and securing of a cap 28. Cap 28 has a longitudinal bore section 29 coaxial with body cavity 24 followed by a reduced diameter bore section 29' in turn followed by a reduced diameter bore section 30 opening at the rear end of cap 28. Radial shoulders 31 and 31' are defined at the junctions of bore sections 29 and 29', and bore sections 29' and 30 respectively. The outer end of cap 28 forms a cylindrical portion 32, of reduced diameter, to receive the cylindrical skirt 33 of an operating knob 34. The end face of cap 28 and the bottom face of the cavity of knob 34 defined by skirt 33 forms co-operating inclined ramps 35, 35', each with a pair of cooperating steps 37, 37' facing in the same rotational direction to therefore form a unidirectional clutch allowing rotation of the knob 34 with respect to the cap 28 only in a clockwise direction, as indicated by arrow 38 in FIG. 4.

The tooth paste supply is contained in a thin wall disposable cartridge 40 removably fitted within the cavity 24 of the tooth-brush body 1. The cartridge 40 is of cylindrical shape, fully opened at its front end 41 and having a back wall 42 provided with a central hole 43 of just sufficient diameter to allow for the passage of a screw 44 extending coaxially within the cartridge 40 to terminate forwardly close to the front end 41 thereof.

The screw 44 is provided at its rear end with an integral head 45 adapted to abut against back wall 42. Head 45 is terminated by a transverse clutching face 46 consisting of two inclined ramps and shoulders facing in the same direction to cooperate with similarly arranged ramps and shoulders of the head 47 of a stem 48 extending coaxial with the screw 44 through the cap bore sections 29, 29' and 30. Stem 48 also extends within a through bore of operating knob 34 and has a flat 49 for engaging a similar flat of the through bore of knob 34 to which it is non-rotatably secured by a bolt 50 engaging a threaded end bore 51 of the stem 48.

A compression coil spring 52 is disposed within bore sections 29 and 29' of cap 28; surrounds the stem 48; and abuts at its forward end against the stem head 47 and at its back end against the shoulder 31′ defined between bore sections 29′ and 30.

The coil spring 32 could be replaced by a spiral spring in order to shorten the bore section 29′.

A piston 53 is threadedly mounted on screw 44 and is disposed within the cartridge 40 in fluid-tight contact therewith. The piston 53 is preferably of resilient material, such as rubber, and has at its periphery a longitudinal groove 54 engageable with a longitudinal rib 55 extending the entire length of the cartridge 40 and formed by upsetting the cartridge wall. Thus, a groove 56 is defined at the external face of the cartridge 40 and this groove 56 receives a rib 57 at the inner surface of body 1 to prevent rotation of the cartridge within body 1. Rib 55, in turn, prevents rotation of piston 53 relative to cartridge 40 and, consequently, relative to body 1.

It will be noted that the screw 44 has a left-hand thread, so that upon rotation of knob 34 in clockwise direction, as indicated by arrow 38, it will move rearwardly against the action of spring 52 and compress the same.

The pitch of screw 44 is substantially equal to the pitch of the ramps 35, so that, upon clockwise rotation of the assembly of knob 34 and screw 44, the knob 34 moves rearwardly along the ramps 35 and there is no separation or unclutching of the heads 45 and 47.

Heads 45 and 47 are preferably of the same diameter and such that they freely enter bore section 29 and that head 47 eventually abuts shoulder 31 in the rearmost limit position of screw 44.

Supposing the tooth-brush is empty, the user inserts a filled cartridge 40 within avity 24 of body 1 by unscrewing cap 28 and inserting a filled cartridge through the open rear end of the body 1.

Filled cartridges are supplied with the screw 44 and piston 52, the screw head 45 protruding from the rear end of the cartridge. The front end 41 of the cartridge is sealed by a thin membrane which is peeled off just before cartridge insertion. Once the cartridge is in position within body 1, the cap assembly 28 is screwed back on threads 27. Thus, the stem head 47 comes in automatic engagement with the screw head 45 by a slight rotation of knob 34. Whenever it is desired to supply a measured amount of tooth paste to the bristles of the brush, knob 34 is rotated clockwise until it can no longer be rotated. Thus, the knob 34, the stem 48 and the screw 44 move rearwardly, the screw unthreading in the non-rotatable piston 53. When stem head 47 abuts step 31, no further knob rotation is possible. The clutch 46 remains in engagement; the coil spring 52 is compressed. Steps 37 and 37′ being cleared, the knob 34 is now free to move forwardly, which it does under the return action of the compressed spring 52. Thus, the piston 53 gradually moves forwardly to an adjusted extent corresponding to the distance between shoulder 31 and end wall 42, and until screw head 45 abuts against cartridge end wall 42.

Thus, the spring 52 causes gradual and slow ejection of a measured ribbon of tooth paste 15 on the brush bristles 5. This is a main function of the spring 52. Another function resides in the fact that it constantly pushes on the cartridge 40 through the heads 45, 47, so that the front end 41 of the cartridge 40 abuts the transverse body wall 25 to seal the cartridge at that zone, to prevent ejection of tooth paste into body cavity 24. The clutch 46 allows separation of the stem 48 from screw 44 and also prevents retraction of the piston 53. The clutch formed by knob ramps 35′ and cap ramps 35 positively prevents retraction of piston 53, should knob 34 be rotated in anticlockwise direction. The height of steps 37 is small compared to the allowable axial movement of screw 44, so that there is only a small variation in the amount of ejected tooth paste depending on the relative angular position of ramps 35 and 35′ after knob 34 has been rotated and is released for forward movement by spring 52.

The provision of the metering device provided by spring 52, head 47 and shoulder 31 positively prevents excessive dispensing of tooth paste 15; just the normal required amount is discharged.

It is easy for the manufacturer to fill the cartridges 40. Filling is carried out through the front end 41 of the cartridge after piston 53 has been inserted through said front end. During filling, the piston 53 moves rearwardly of the cartridge to finally abut against wall 42. Then the screw 44 is inserted through the back end of the cartridge and screwed within the piston 53, so that it moves to its final forward position, the piston 53 remaining at the back end of the cartridge. Then the cartridge is sealed at its front end 41.

What I claim is:

1. A fountain type tooth-brush comprising an elongated hollow body forming a handle and open at its rear end, a tooth paste containing cartridge removably and non-rotatably located within said hollow body, a stem carried by the forward end of said body and carrying a tooth-brush head and tooth-brush bristles at the forward end thereof, said stem and tooth-brush head having a tooth paste passage opening within said tooth-brush bristles and in communication with the interior of said cartridge in said body for the supply of tooth paste from said cartridge to said brush bristles, said cartridge having a rear end wall, a piston longitudinally displaceable within said cartridge and non-rotatably mounted therein, a screw threaded within said piston, freely extending through a hole of said cartridge rear end wall and having a head secured to the end portion of said screw protruding rearwardly of said cartridge rear end wall, a cap removably secured to the rear end of said body and freely enclosing said head, a stem coaxial with said screw, extending within said cap, said cap having a rear end portion provided with a guiding hole, said stem axially displaceable and rotatable within said guiding hole of the rear end of said cap, said stem protruding rearwardly of said cap, an operating knob secured to the protruding rear end portion of said stem, said stem having at its forward end a head located within said cap and in clutching and removable engagement with the screw head, a compression spring member disposed within said cap surrounding said stem and abutting at its rear end against the rear end wall of said cap and at its forward end against the stem head and urging the stem, stem head and screw forwardly of said body to a forward limit position in which said screw head abuts against the back of the rear end wall of said cartridge, rotation of said stem by means of said knob in one direction causing rotation of said screw through said clutched screw head and stem head in one direction, in turn causing rotation of said screw and rearward displacement of the assembly of the stem and screw to compress the spring member and move the screw head rearwardly away from said cartridge rear end wall, release of said operating knob allowing said spring member to produce forward movement of the screw and piston, such as the latter will produce pressure on the tooth paste in the cartridge ahead of the same to discharge said tooth paste to the brush bristles.

2. A fountain type tooth-brush as claimed in claim 1, wherein the interior of said cap forms an abutment surface spaced rearwardly from the stem head in the forward limit position of the latter and against which said stem head abuts in a rear limit position of the assembly of the screw head and stem head and screw and stem to therefore determine the maximum quantity of tooth paste discharged under the action of said spring member.

3. A fountain type tooth-brush as claimed in claim 1, wherein said screw head and said stem head have mutually engageable ramp and step means forming a unidirectional clutch.

4. A fountain type tooth-brush as claimed in claim 1, further including a unidirectional clutch formed at engageable faces of said cap and knob to allow rotation of said knob in only one direction.

5. A fountain type tooth-brush as claimed in claim 1, wherein said tooth-brush head carries a flexible feed tube of circular cross-section in communication with said passage at one end and extending within the array of said tuft bristles, said tube terminating short of the outer ends of said bristles and having a closed end provided with a discharge slit, said slit opening under tooth paste pressure within said tube and automatically closing when said pressure is released.

* * * * *